US011786017B2

(12) United States Patent
Granito

(10) Patent No.: US 11,786,017 B2
(45) Date of Patent: Oct. 17, 2023

(54) BAND CLASP COMPRISING A DEVICE FOR ADJUSTING BAND LENGTH

(71) Applicant: DEXEL S.A., Bienne (CH)

(72) Inventor: Elio Granito, Bienne (CH)

(73) Assignee: DEXEL S.A., Bienne (CH)

( * ) Notice: Subject to any disclaimer, the term of this patent is extended or adjusted under 35 U.S.C. 154(b) by 159 days.

(21) Appl. No.: 16/975,228

(22) PCT Filed: Mar. 4, 2019

(86) PCT No.: PCT/EP2019/055351

§ 371 (c)(1),
(2) Date: Aug. 24, 2020

(87) PCT Pub. No.: WO2019/166671

PCT Pub. Date: Sep. 6, 2019

(65) Prior Publication Data

US 2020/0405018 A1 Dec. 31, 2020

(30) Foreign Application Priority Data

Mar. 2, 2018 (EP) ..... 18159841

(51) Int. Cl.
*A44C 5/24* (2006.01)

(52) U.S. Cl.
CPC ..... *A44C 5/246* (2013.01)

(58) Field of Classification Search
CPC ..... A44C 5/246; A44C 5/24; A44C 5/185; Y10T 24/2155; Y10T 24/4782; Y10T 24/4745
See application file for complete search history.

(56) References Cited

U.S. PATENT DOCUMENTS

| | | | | |
|---|---|---|---|---|
| 2,588,655 | A | 3/1952 | O'Neill | |
| 7,289,310 | B1 * | 10/2007 | Yuan | A61N 1/14 361/231 |
| 8,001,658 | B2 * | 8/2011 | Christian | A44C 5/246 24/71 J |
| 8,789,245 | B2 * | 7/2014 | Leger | A44C 5/246 24/71 J |
| 11,089,849 | B2 | 8/2021 | Granito | |
| 2012/0240361 | A1 * | 9/2012 | Leger | A44C 5/246 24/265 EC |
| 2012/0297592 | A1 * | 11/2012 | Schenk | A44C 5/246 24/71 R |

FOREIGN PATENT DOCUMENTS

| | | | |
|---|---|---|---|
| CH | 699067 | A1 | 1/2010 |
| EP | 2875747 | A1 | 5/2015 |

* cited by examiner

*Primary Examiner* — Robert Sandy
*Assistant Examiner* — Rowland Do
(74) *Attorney, Agent, or Firm* — Robert C. Netter, Jr.; Dann, Dorfman, Herrell & Skillman

(57) ABSTRACT

The invention relates to a clasp for bracelets with a length adjustment device, wherein the adjustment device is devoid of a locking mechanism for blocking the length adjustment and/or of an activation member for unblocking a locking mechanism in order to allow the length adjustment in at least one direction of the length of the bracelet. The clasp enables a user to finely adjust the useful length of the bracelet by thrust or traction on the bracelet strand.

15 Claims, 7 Drawing Sheets

BAND CLASP COMPRISING A DEVICE FOR ADJUSTING BAND LENGTH

This application is a § 371 application of PCT/EP2019/055351, filed Mar. 4, 2019, which claims priority to European Patent Application No. 18159841.8, filed Mar. 2, 2018. The entire disclosure of each of the foregoing applications is incorporated by reference herein.

TECHNICAL FIELD

The present invention concerns a clasp for a bracelet, in particular a clasp for adjusting the length of the bracelet. The invention also concerns a folding clasp and a wristwatch comprising such a clasp.

State of the Art and Problems Forming the Background to the Invention

Bracelets for wristwatches usually have means to adjust the length of the strap. For example, in the case of leather or plastic bracelets, the free end of one of the two strands of the bracelet has a series of holes distributed in the longitudinal direction of the bracelet. The free end of the other strand of the bracelet has a connecting device, such as a pin buckle, to join the two strands by inserting the pin into the hole corresponding to the desired length. In the case of metal link bracelets, the length of the bracelet is adjusted by removing or adding a link in one or both strands of the bracelet. However, in either case, the possible adjustments to the useful length of the strap are quite rough and the perimeter of the watch wearer's wrist may lie between two adjacent adjustments.

The state of the art has clasps for wristwatches that allow fine adjustment of the length of the bracelet. Such a fine adjustment is desirable to precisely adapt the length of the strap to the wrist of the wearer of a wristwatch. On the other hand, as raised in EP 2361523, the size of a wearer's wrist can vary with changes in temperature, for example.

Many clasps with a mechanism for fine length adjustment are known to be state of the art. These mechanisms include a blocking or locking device or member to prevent unintentional or accidental lengthening and/or shortening. In many clasps, special attention is paid to preventing unintentional lengthening, as the risk of unintentional shortening is lower. On the other hand, the possibility of being able to shorten the bracelet quickly, without the need to activate an unlocking mechanism, is even desirable for the wearer, as this possibility allows the bracelet to be tightened around the wrist simply and at any time. For example, a user whose hand wearing the wristwatch is busy can still tighten the strap around his or her wrist by pressing a strand of the strap with the other hand in the direction to decrease the length of the strap. The European patent EP2875747B1 shows a clasp allowing to finely reduce the length of the bracelet by exerting a force on the bracelet strand attached to a movable part. This clasp, however, has a locking element with a tooth to ensure that a movable part is held in a predefined position. In order to extend the bracelet, the user is obliged to open the clasp and press down on a support surface in order to release the tooth and move the movable part in the direction of the extension of the bracelet. The construction of the clasp shown in EP2875747B1 is relatively simple compared to other clasps with a mechanism for fine adjustment of the length of the bracelet. Nevertheless, it may be desirable to further reduce the complexity of the mechanism and further reduce the number of pieces.

One objective of the present invention is to simplify or even dispense with a locking device and the activation or manipulation element which must be activated by a wearer in order to be able to extend the bracelet. Another objective of the invention is to facilitate the adjustment of length in both directions, and not only in the direction of shortening the bracelet, while minimizing the risk of accidental and involuntary length change.

U.S. Pat. No. 2,588,655 discloses a wristband clasp that allows the length of the wristband to be adjusted without having to activate a locking device. This mechanism has several drawbacks. On the one hand, it does not allow a discrete and stable value for the length of the bracelet to be adjusted, as there is always a certain amount of play and residual extensibility. On the other hand, to open the clasp, it is necessary to first extend the adjustable length to the maximum. It would be advantageous to use a clasp in which the fine adjustment and opening of the clasp can be activated independently of each other.

CH 699 067 discloses a clasp with ratchets and two pairs of holes, allowing a user to adjust the length of the bracelet without having to activate an activation mechanism. It would be desirable to implement a mechanism to adjust the force required to adjust the length, for example so that the force required to shorten the bracelet is less than the force required to extend the useful length of the bracelet.

SUMMARY OF THE INVENTION

The present invention relates to a clasp comprising a device for adjusting the useful length of the bracelet making it possible to extend said useful length without the need to activate an unlocking mechanism, by acting directly on a strand connected to the clasp.

According to a first aspect, the invention concerns a clasp, preferably for bracelets, comprising a length adjustment device, characterised in that said adjustment device is devoid of a locking mechanism for blocking the adjustment of the length of the bracelet in at least one direction and/or of an activation member such as a push-piece, a pull-piece and/or a slide, said activation member being intended to unblock a locking mechanism in order to allow the adjustment of the length of the bracelet in at least one direction.

According to a second aspect, the invention relates to a clasp, preferably for bracelets, comprising a device for adjusting the useful length of the bracelet, said device for adjusting the useful length comprising a movable part and a support device, the movable part being arranged to be able to perform a movement relative to said support device during a length adjustment, the movable part comprising a stop structure and the support device comprising an indexing member, or vice versa, said stop structure being intended to be positioned in a notch of the indexing member, in order to determine a discrete and stable value of the length of the bracelet.

According to a second aspect, the invention relates to a clasp, preferably for bracelets, comprising a device for adjusting the useful length of the bracelet, said device for adjusting the useful length comprising a movable part and a support device, the movable part being arranged to be able to perform a movement relative to said support device during a length adjustment, the movable part comprising a stop structure and the support device comprising an indexing member, or vice versa, said stop structure being intended to be positioned in a notch of the indexing member integral with said support device or said movable part, in order to determine a discrete and stable value of the length of the bracelet.

According to another aspect, the invention relates to a clasp, preferably for bracelets, comprising a device for adjusting the useful length of the bracelet, said device for adjusting the useful length comprising a movable part and a support device, the movable part being arranged to be able to perform a movement relative to said support device during a length adjustment, the movable part comprising a stop structure and the support device comprising an indexing member, or vice versa, said stop structure being intended to be positioned in a notch of the indexing member integral with said support device or said movable part, respectively, in order to determine a discrete and stable value of the length of the bracelet, characterised in that said movable part, said stop structure and said notch are arranged in such a way that when a determined force is exerted by a user, said force acting in a longitudinal direction on said movable part or on a bracelet strand connected to said movable part, said force acts on said stop structure so as to disengage said stop structure from said notch and to cause a displacement of the movable part in the longitudinal direction resulting in an extension of said useful length of the bracelet.

According to yet another aspect, the invention relates to a clasp for a wristwatch and/or a wristwatch comprising the clasp of the invention.

In an embodiment, said movable part is arranged with respect to the indexing member in such a way that the movement of the movable part during the application of a thrust exerted by a user acting directly on said movable part or on a bracelet strand connected to said movable part causes the useful length of the bracelet to be shortened.

In one embodiment, said movable part is arranged with respect to the indexing member in such a way that the movement of the movable part during the application of a traction exerted by a user acting directly on said movable part or on a bracelet strand connected to said movable part causes the useful length of the bracelet to be lengthened.

In one embodiment, the thrust and/or traction force required to allow movement of the movable part is determined at least in part by the profiles and/or shapes of the stop structure and of the notches for receiving said stop structure in order to determine a discrete length value.

In one embodiment, said indexing member comprises a plurality of notches, said notches comprising at least one contact structure, preferably a contact surface, and said stop structure comprising a bearing surface arranged to be in contact with said contact structure and to slide on said contact structure during a movement of the movable part causing the extension and/or shortening of the useful length of the bracelet.

In one embodiment, said stop structure is a tooth comprising a first and a second bearing surface, and said bearing surfaces, viewed in profile, each follow a straight line, each of the straight lines forming an angle with respect to a radial axis, each of the angles being non-zero, preferably greater than 10°.

In an embodiment, said movable part comprises a carriage and said stop structure is arranged relative to the carriage so as to be movable in a direction including a radial component, the radial component of the movement allowing said stop structure to slide over a support structure of a notch and to disengage from said notch in which said structure is positioned.

In an embodiment, said indexing member and said stop structure of the movable part are arranged such that the force in longitudinal direction, preferably a push, required to carry out the movement of the movable part to shorten the length of the bracelet is smaller than the force, preferably a pull, required to carry out the movement of the movable part to lengthen the bracelet.

In an embodiment, said length adjustment is a discontinuous fine length adjustment in discrete length values.

In one embodiment, the clasp is arranged to allow length adjustment when the clasp is in the open position as well as when the clasp is in the closed position.

Other aspects of the invention and preferred embodiments and implementations are defined in the claims and in the following description.

BRIEF DESCRIPTION OF THE DRAWINGS

The characteristics and advantages of the invention appear more clearly on reading the following description of a preferred embodiment, the description being given merely by way of non-limiting example, and with reference to the accompanying drawings, in which.

DESCRIPTION OF THE EMBODIMENTS

Figure 1:
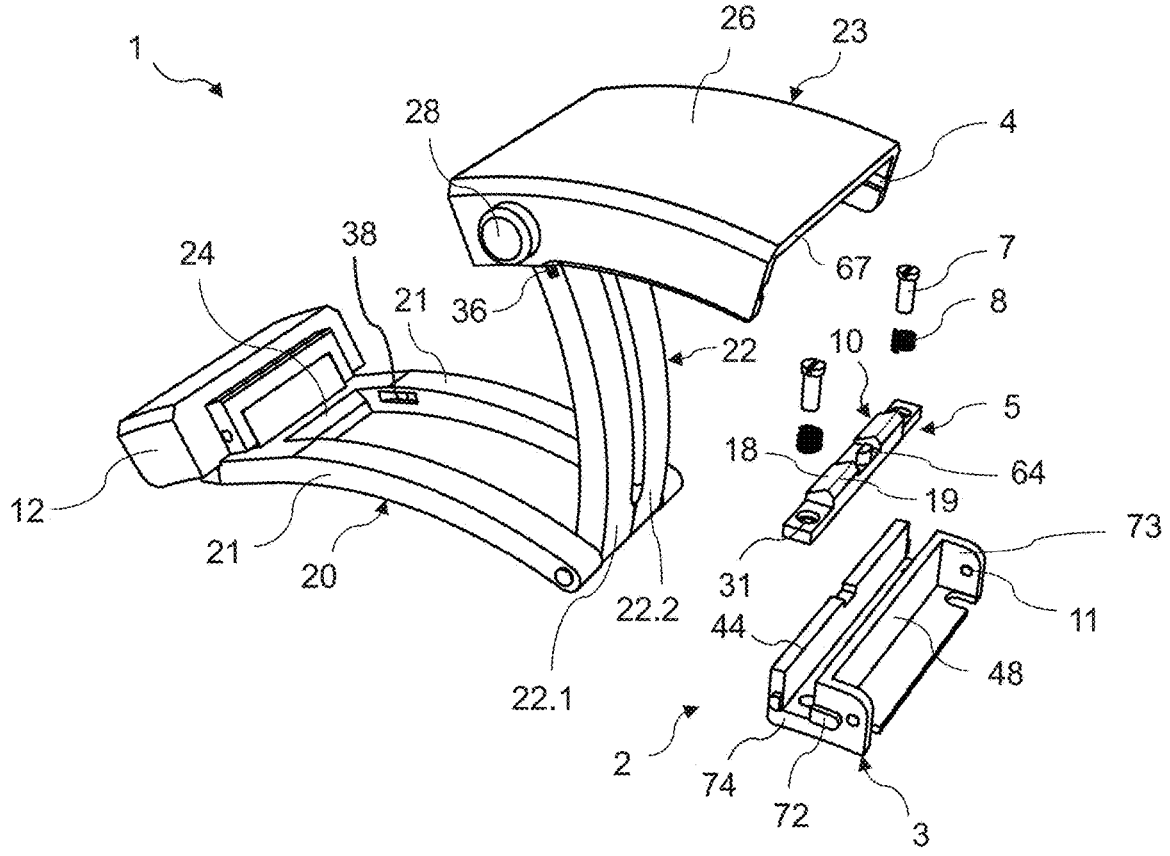
FIG. 1 is a perspective view of a clasp according to a first embodiment of the present invention.

The clasp illustrated in a non-limited way on the figures corresponds to a preferred mode of realization of the present invention. In particular, clasp 1 is of the type with a folding clasp and is intended in particular to close a watch strap. The bracelet can be of any type, such as soft plastic, leather, or made by an assembly of metal links.

In general, clasps with a device for fine adjustment of the useful length of the bracelet comprise at least two parts arranged so as to be able to perform a relative movement in the longitudinal direction with respect to each other. Each of the two parts has a fastening device. A first fixing device is intended to be connected to a first bracelet strand, and the second fixing device is intended to be connected to a second bracelet strand. In this configuration, the relative movement mentioned above causes the fastening elements to move closer or further apart and thus shortens or lengthens the useful length of the bracelet.

Often, one of the two parts arranged to be able to perform the relative movement is referred to as the "movable part". In this description, the same designation is used and the other of the two parts is referred to as the "support device". Since it is a relative movement between two parts and/or two assemblies, which part is considered the "movable part" is only a matter of convention. This designation is arbitrary as it is a relative displacement. Usually the smaller of the two parts is called the movable part, the other part often having the mechanism for closing and opening the clasp, for example in the form of hinged blades. In the context of the present invention, the "movable part" could be called the "first movable part" and the "support device" could be called the "second movable part", the first and second movable parts being capable of relative movement in the longitudinal direction.

Typically, the movable part and the support device cooperate by means of an indexing member, such as a notch sequence, a rack, and/or a toothing, for example, on the one hand, and a stop structure, a jaw or a lock, on the other hand, intended to cooperate with the indexing member in order to determine discrete values of useful length.

The difference in length between the values is determined by the spacing between the notches of the indexing member. A discrete and stable value corresponds to a concrete position, defined by the positions of the notches, in which the movable part is stabilised and/or stopped with respect to the support device by the interaction of the stop structure and the rack in the absence of an external force.

In the case of the embodiment shown in FIGS. 1-7, the indexing member 6 is associated with the support device 20-23 and the stop structure 10 is associated with the movable part. The clasp can also be made vice versa, i.e. by associating the indexing member 6 with the movable part and the stop structure 10 with the support device 20-23, without going beyond the scope of the present invention.

FIGS. 8A to 14B show the embodiments in which the two structures, the indexing member and the stop structure, are arranged in reverse, i.e. the indexing device is associated and thus rigidly connected with the movable part. In general, the indexing member is preferably integral with the structure with which it is associated, either with the support device (FIGS. 1-7) or with the movable part (FIGS. 8A-14B), as the case may be. The stop structure is arranged on the other of the two structures respectively, in order to be able to generate cooperation between the two structures.

Clasp 1 shown in FIGS. 1-7 has a conventional "clasp" function, i.e. not considering the device for fine adjustment of the useful length of the bracelet, which clasp function is described in detail in patents EP 0913106B1 and EP2875747B1, issued in the name of the applicant.

These conventional functions of clasp 1 will be described briefly below. Clasp 1 is intended to be connected to two strands of a bracelet (not shown) in a known manner, in particular to the free ends of the strands. As described in patents EP0913106B1 and EP2875747B1 mentioned above, clasp 1 has a base 20, elongated in the longitudinal direction of the bracelet and slightly curved over at least part of its length to better fit the shape of a wearer's wrist.

The terms "direction of the length of the bracelet" or "longitudinal direction of the bracelet" are used in this description to refer to an axis which is that of the two bracelet strands, assuming that the bracelet is laid flat and detached from a watch. When the bracelet is closed, the "direction of the length of the bracelet" refers to the line that follows the circumference of the bracelet. The fine-adjusted length of the bracelet adjusted by means of the device for adjusting the useful length according to the invention is in the direction of the length of the bracelet. In the case of a wristwatch with a conventional dial, an axis connecting the numerals 6 and 12 on the dial generally follows the direction of the length of the bracelet in accordance with this definition.

The clasp shown in FIGS. 1-7 is substantially symmetrical and therefore has a plane of symmetry extending in the direction of the length of the bracelet. The terms "orthogonal" and "transversal" refer to an axis that is perpendicular to the "direction of the length of the bracelet" and perpendicular to the plane of symmetry of the clasp. In the case of a wristwatch with a dial, an axis connecting the numerals 3 and 9 on the dial generally follows an "orthogonal" in accordance with this definition.

A "radial" axis is an axis that is radial to the axis of the wrist or forearm of a wristwatch wearer. The radial axis extends in the plane of symmetry or in a plane parallel to the plane of symmetry. In the view of FIGS. 3, 4A-4D, 5, 6, and 7, the "radial" axis is a substantially "vertical" axis, and the two terms are generally used interchangeably in this description.

In the context of the profile of the stop structures and notches of the indexing member, the "vertical" is a straight line and preferably a plane that is normal to the direction of movement of the movable part.

Figure 3:
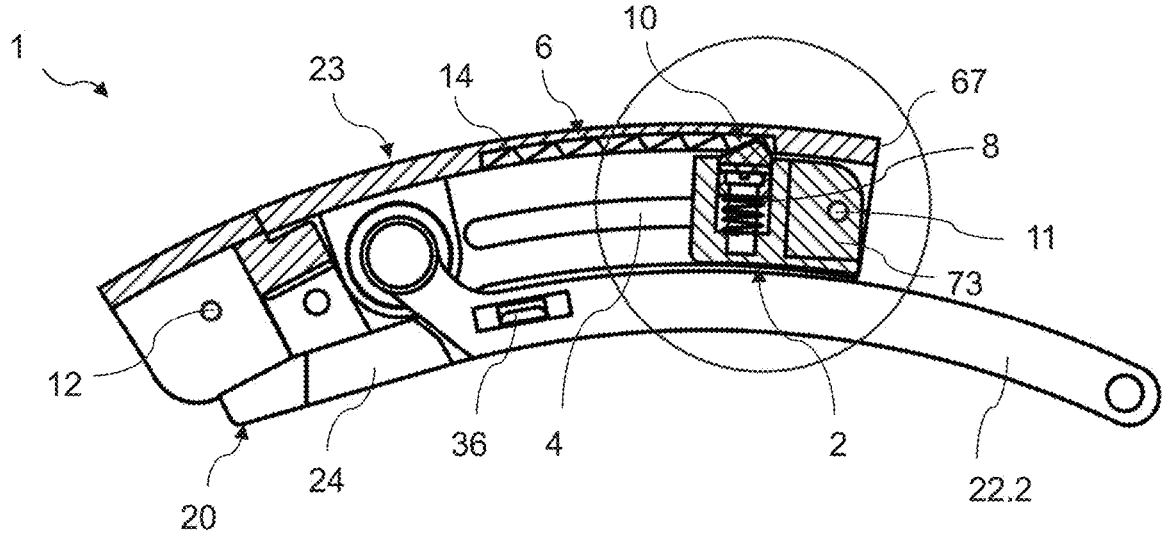
FIG. 3 is a longitudinal section view of the clasp of FIG. 1 in a first configuration.

The terms "bottom" and "top" generally refer to the bottom and top of the clasp, respectively, as shown in FIG. 3. The terms "below" and "above" are to be understood in a similar way, the structural elements close to the wrist being "below" the more distant elements.

While the terms "longitudinal direction of the bracelet", "orthogonal" and "radial" refer to the orientation of an element of the clasp or an axis of that element, these terms generally refer to the orientation of the element or its axis when the clasp is closed.

The base 20 consists of two stringers 21 spaced apart from each other and attached to a cross strut 24 at one end of the stringers 21. A fastening element 12 intended to be connected to a free end of the bracelet, by means of a bar or rod (not visible), is rigidly connected with the cross strut 24. In the present description, member 12 corresponds to a second fastening member intended to be connected to a second bracelet strand (not illustrated), the first fastening member 11 being connected to the movable part as described below.

A folding arm 22 consisting of two arms 22.1 and 22.2 is pivotally mounted at the opposite end of the longitudinal members 21 in a conventional manner. The opposite ends of the arms 22 are used both to connect the cover 23 to the arms 22.1, 22.2 and to house the pushers 28 which enable the activation of the clasp locking mechanism allowing the clasp to be opened by unfolding the arm 25 from the base 20. Push-buttons 28 are arranged so that they act on the arms 22.1, 22.2 to bring them closer together when they are operated by a user wishing to open clasp 1. The relative approximation of the two arms 22.1, 22.2 has the effect of releasing claws 36 on the arms and inserted in complementary recesses 38 in the base 20, as described in detail in patents EP0913106 91 and EP2875747B1.

In this description, a "user" is preferably a wearer of the clasp, preferably an individual wearing a wristwatch with the clasp on his wrist.

In the embodiment shown in the figures, the device for adjusting the useful length of the bracelet is associated with cover 23.

The adjusting device comprises a movable part 2 with a carriage 3 slidably mounted inside the cover 23. For this purpose, carriage 3 has a pair of lateral guide pads 72 for insertion into two guide grooves 4, respectively provided on both sides on the inner sides of the two side walls 68 of cover 23. In the embodiment shown, the guide grooves 4 have the same curvature as cover 23. They each open at one end of the corresponding side wall.

Each guide pad 72 is designed to cooperate with a guide groove 4. Thanks to these features, carriage 3 can be engaged under cover 23 by engaging the guide pads 72 to slide under it. The guide pads 72 preferably have an elongated shape in the longitudinal direction of the bracelet, so that carriage 3 can only move by sliding along the guide grooves 4.

Carriage 3 accommodates a transverse part 5 which, in the embodiment shown, has an elongated shape and the general appearance of a bar. Part 5 has a stop structure 10. In the embodiment shown, the stop structure has two teeth 10. The two teeth 10 are arranged on the same transverse axis and are separated by a gap in which a locking pin 64 is arranged. Below, the singular and plural forms of the term "tooth" refer to the same stop structure comprising the two teeth 10. The present invention is not limited by the number of teeth used to form the stop structure and covers, for example, the use of one or more stop structures, for example two partial stop structures, together forming a stop structure.

The mounting of part 5 on carriage 3 is such that it allows only one degree of freedom for part 5 to move when part 5 is mounted on carriage 3, and when carriage 3 is mounted under cover 23. Part 5 has two holes 31 near its lateral ends. As can be better seen in FIG. 6, a screw 7 is inserted in each of these holes to connect part 5 to carriage 3. Resilient means 8, here springs, are arranged on the screw shank between the bottom 74 of carriage 3 and the underside of part 5 in such a way that they bias part 5 radially upwards, while allowing the part to lower when a force in the opposite direction, downwards, acts on part 5. In other words, in the embodiment shown, part 5 with tooth 10 is mounted so that it can perform a translational movement, preferably a rectilinear one. Preferably, this translational movement takes place along a radial axis. In the embodiment shown, this movement is guided by the two screws 7.

On the other hand, part 5 is housed between a front wall 44 and a rear wall 48 which help guide the translation of part 5 in a radial direction with respect to carriage 3. These walls are connected to the bottom 74 of carriage 3. After installation in the cover, part 5 is additionally blocked laterally by the side walls 68 of cover 23 (FIG. 6).

Figure 2:
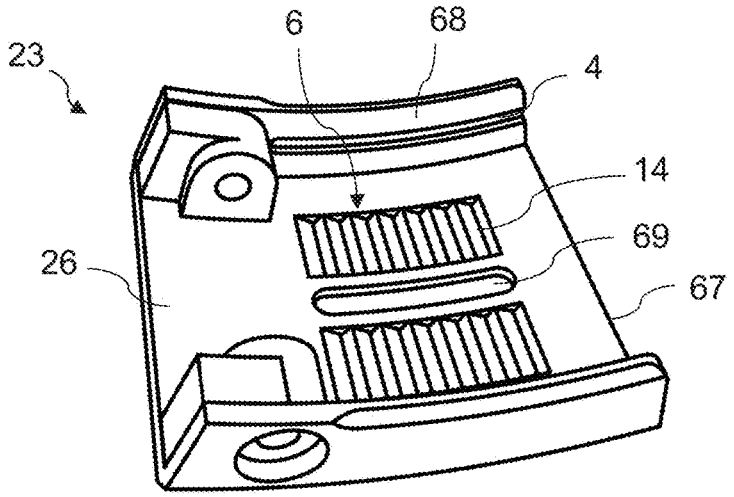
FIG. 2 is a perspective view showing the lower surface of the clasp cover of FIG. 1.

In FIG. 2, the underside of cover 23 is visible. A central longitudinal groove 69 is provided on the inside of the top wall 26 of cover 23. On either side of the central groove, two indexing members 6 are provided in the underside of wall 26. In the embodiment shown, these indexing members 6 are constructed in the form of two parallel racks or gears 6. In general, the indexing member can be made, for example, as a series of notches 14 or two parallel series of notches, for example. In this description, reference number 14 is used both to refer to any notch in general and to designate a particular notch.

Figure 6:
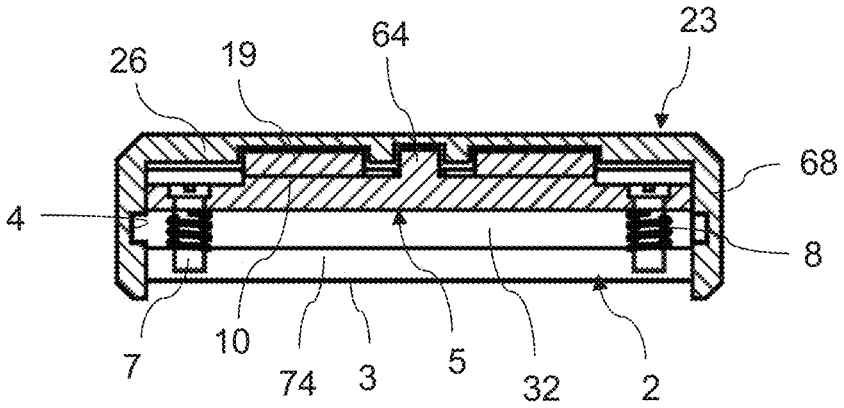
FIG. 6 is a transverse section view of the cover and the movable part of the clasp in FIG. 1.
Figure 7:
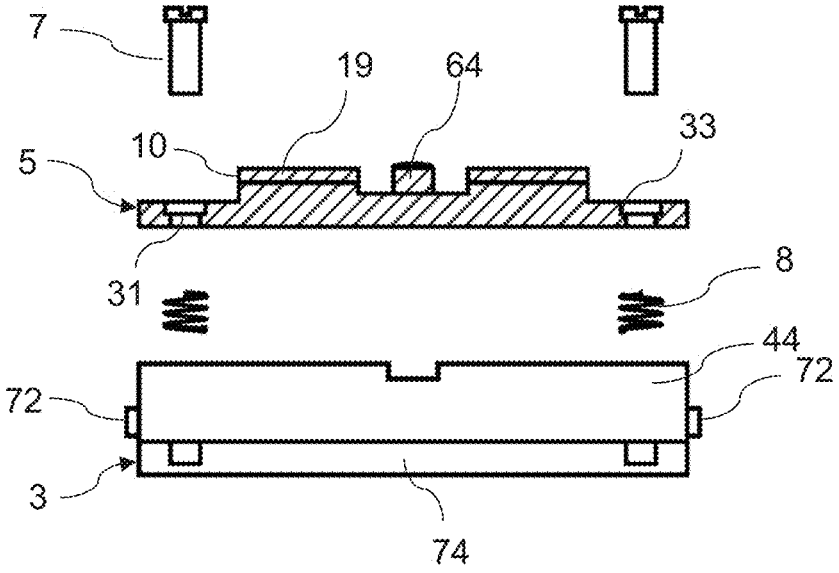
FIG. 7 is an exploded front view of the movable part of the clasp in FIG. 1.

When the movable part 2 is mounted in the cover, each of the teeth 10 cooperates with one of the indexing members 6, as shown in FIGS. 3 and 6 and described in more detail below. It should also be noted that the maximum stroke finger 64 is arranged in the middle on part 5. This finger 64 is intended to slide in the central groove 69, so that the ends of the groove serve as the travel stop for carriage 2.

Carriage 3 has a pair of side walls or lugs 73, each with a transverse hole 11. These holes serve as the first fixing device 11, as they allow a spring bar to be housed in a manner known per se. The free end of a first bracelet strand can be connected via this bar to carriage 3 of the movable part 2.

When assembling the movable part 2 in cover 23, part 5 is first screwed between the front and rear walls 44, 48 of carriage 3, as shown in FIG. 6. Each of the screws 7 passes through one of the holes 31 in part 5 and the inner space of one of the springs 8, and is anchored in the frame or bottom 74 of carriage 3. The springs 8 are pushed onto the screw drums between part 5 and the carriage frame, so that a gap 32 is formed between the carriage frame and part 5. Thanks to this arrangement, part 5 can move in a radial direction, guided by screws 7 and along a distance defined by the height of the head of the screws 7. The heads of the screws 7 are housed in a recess 33 arranged in each of the holes 31 to retain part 5. The movement of part 5 is counteracted by the spring force downwards or biased by the spring force upwards in FIGS. 3 and 6.

Assembly 2 is then attached to cover 23 by inserting the side pads 72 through the open ends of the side grooves 4. When the movable part 2 is pushed into the side grooves, part 5 is forced to lower into its housing between walls 44 and 48, because edge 67 of the free end of the cover 23 acts by reaction force on teeth 10 of part 5, and this force is transmitted to the springs. By lowering part 5 into its carriage 3 against the force of the springs 8, the movable part can be inserted during assembly. When the movable part 2 is pushed further into the cover, the teeth 10 of part 5 are continuously pressed towards the underside of the cover (upwards) until the teeth 10 engage with the racks 6. At this point, the teeth 10 engage with the first notch of the racks 6 and the stroke finger 64 engages with the central groove 69. In this configuration, shown in FIG. 3, the movable part 2 is stably associated with cover 23, it can then only carry out the movement intended for the adjustment of the working length as described below.

A particularity of the clasp of the invention is that it lacks, in a preferred embodiment, an actuating or manipulating member designed to unlock the fine-adjustment stop structure from its engagement with the indexing member. Such a release is necessary in state-of-the-art clasps in order to be able to move the movable part in at least one of the two directions of the useful length adjustment. In general, at least the adjustment allowing the extension of the useful length of the bracelet is prevented by a locking or blocking mechanism requiring then an unlocking by means of an actuating element. Preferably, the clasp of the invention is devoid of such a manipulating member to carry out the unlocking of the fine adjustment. The clasp preferably also lacks a locking mechanism that completely blocks the movement of the movable part in at least one longitudinal direction.

The invention resides in the implementation of an indexing mechanism making it possible to stabilize the movable part 2 with respect to the other parts of the clasp, here called "support device" 20-23, while allowing an adjustment of the useful length by the application of a force by the user in a precise direction, generally in the desired direction, of shortening or lengthening the length.

In the embodiment shown, this mechanism is based on the configuration and/or the geometrical shape of the stop structure 10 of the movable part 2 and the indexing member 6 cooperating with the stop structure 10, and more precisely on the complementary and cooperating geometrical shapes of the stop structure 10 and the indexing member 6. Preferably, these shapes are chosen so as to allow movement of the movable part even in the absence of a release. Preferably, the geometrical shapes determine, together with the force of the return means 8, the force required to perform a movement allowing the adjustment of the working length.

In the embodiment shown in the drawings, stop structure 10 has one tooth. In contrast to the solution presented in patent EP2875747, the two flanks 18, 19 of tooth 10 are inclined with respect to a radial axis. Since none of the flanks of tooth 10 is vertical, there is no complete locking, and the profile and/or inclination of each of the tooth flanks is preferably chosen so as to determine the force required to enable the displacement of the movable part in the longitudinal direction.

Figure 4A:
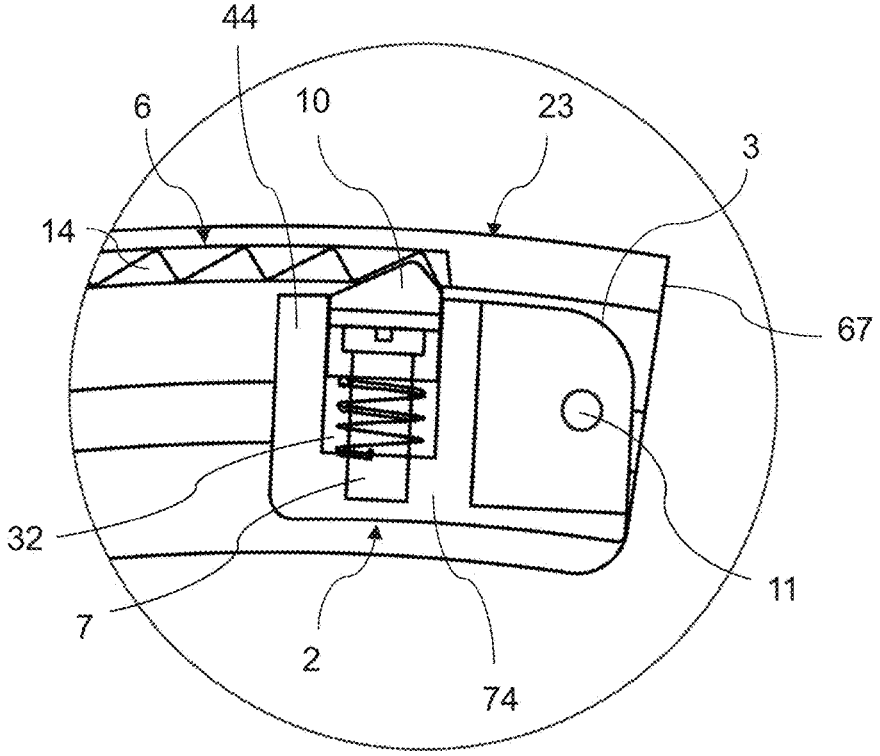
FIGS. 4A, 4B, 4C and 4D are simplified extract of a longitudinal section of the clasp in FIG. 1 in different configurations.
Figure 4B:
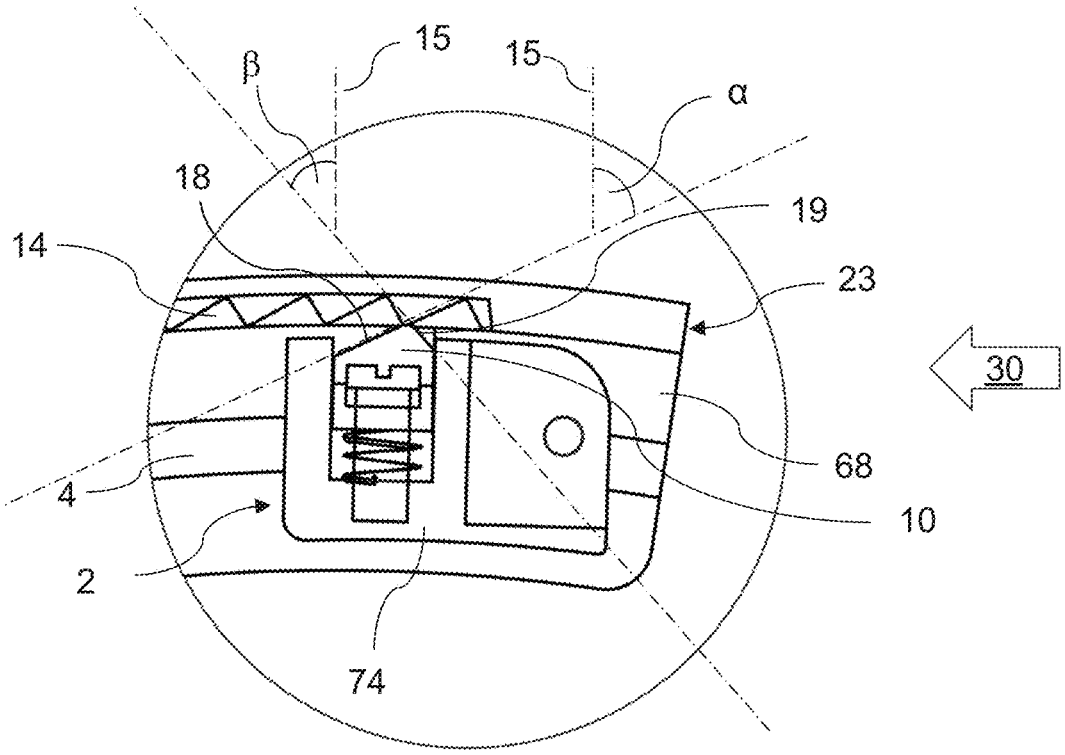
Figure 4C:
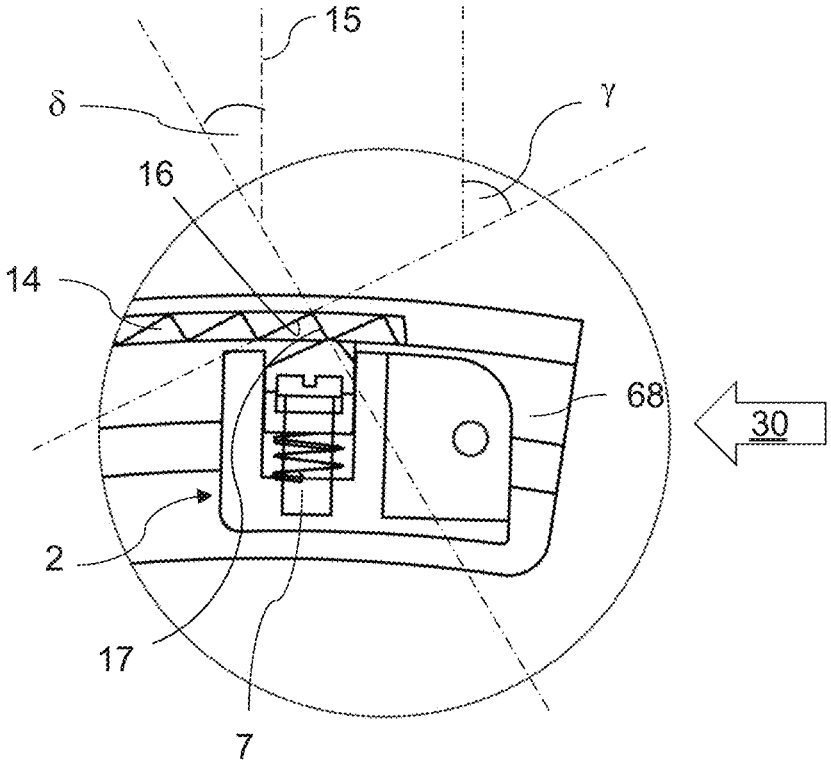

In FIGS. 4B and 4C, the profiles of tooth 10 of the stop structure and notches 14 of the indexing member are visible and the angles of the tooth flanks and notches to a vertical 15 are shown. In FIG. 4B, the first flank 18 (the "front" flank) of tooth 10 is straight and follows an angle α of approximately 63° from the vertical 15, which is approximately 27° from a horizontal axis in FIG. 4A. The opposite flank 19 of tooth 10 (the second or rear flank) forms an angle ß of approximately 42° with the vertical 15.

Figure 4D:
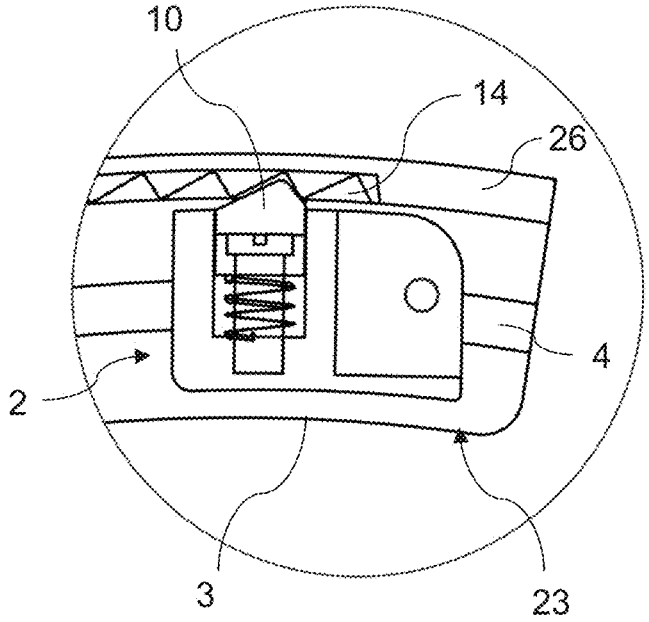

The notches 14 of indexing member 6 have a profile that is substantially complementary to that of tooth 10, in order to allow tooth 10 to be received and to determine a position of discrete length, stabilised by the cooperation of complementary shapes, as shown in FIGS. 3, and 4A and 4D. This discrete position is also stabilised by the action of spring 8, which pushes the tooth in a vertical direction towards a notch 14, in order to bring the tooth into engagement with the notch.

In the embodiment shown, the indexing member 6 is designed as a tooth or toothed rack. The notch geometry 14 is essentially defined by the interdental space, i.e. the tooth gap of tooth 6.

In FIG. 4C, the first and second flanks or bearing surfaces 16, 17 are shown. The profile of the first supporting surface 16 follows a straight line at an angle γ to the vertical 15. The profile of the second bearing surface 17 follows a straight line at an angle δ to the vertical 15.

Considering the three dimensions, flanks 16, 17 (as well as flanks 19, 17) are plane and these planes are preferably inclined with respect to the direction of movement of the movable part. If vertical 15 is considered as a plane extending in an orthogonal direction, planes 16, 17, 18, 17 intersect the vertical plane at an angle (α, β, γ, δ), so that the intersection substantially follows the orthogonal direction.

Due to the complementarity between each of notches 14 and tooth 10, the first profiles 18, 16, respectively of tooth 10 and notch 14, intended to be in contact in an indexing position, are preferably substantially parallel. Therefore, the angles α and γ formed between these profiles and the vertical are preferably substantially identical, for example identical within an error margin of 0 to 10 degrees, preferably 0 to 5 degrees.

Similarly, the second profiles 19, 17, respectively of tooth and notch 14, intended to be in contact in an indexing position, are preferably substantially parallel. Therefore, the angles ß and δ formed between these profiles and the vertical are preferably substantially identical, for example identical within a range of 0 to 10 degrees, preferably 0 to 5 degrees.

In the embodiment shown, the angles α and ß are not identical. Consequently, tooth 10 has an asymmetrical profile. Preferably, the value of the angles α and ß differs by at least 4°, preferably by at least 8°, more preferably by at least 14°. For example, α is at least 4° larger than ß. The profile of notches 14 is also asymmetrical, due to their complementary configurations, allowing the notch to receive the tooth in a substantially "custom-made" manner. At this point it should be mentioned that the tooth of the structure in patent EP2875747B1 is also asymmetrical, but one side of the tooth profile is substantially vertical, therefore a release of the tooth by means of a separate mechanism is necessary. In the case of the aforementioned patent, the entire stop structure is pivotable, and a user can actuate a kind of pusher to disengage the tooth from the notch.

FIGS. 3, 4A-4D illustrate the decrease in the useful length of the bracelet. Thus, the movable part 2 is moved from left to right in relation to the other parts of the clasp, in particular in relation to the cover 23 and in relation to the set of folding blades 22, 23, when the clasp is closed. The clasp can remain closed during this shortening, as shown in the figures. As mentioned, the end of a first bracelet strand is attached to a fixing device 11 of carriage 3. A user can perform shortening by grasping the strap strand between thumb and index fingers and pushing in the direction of arrow 30 (FIG. 4B), i.e. directly in the direction of the desired shortening. The thrust force in longitudinal direction 30 will be transmitted to tooth 10. Specifically, the force acts from the first flank 18 of tooth 10 on the first bearing surface 16 of a notch 14, with which flank 18 is in contact. As the bearing surface 16 cannot move, it transmits a reaction force to tooth 10. The latter is loaded in its vertical position by spring 8 and the reaction force is transmitted by part 5 to the spring. If the force is high enough, the spring 8 is compressed and tooth 10 is forced down into its seat while carriage 3 moves in longitudinal direction 30, as shown in FIGS. 4B and 4C. During this movement, the tooth leaves its notch and then engages the next notch, as shown in FIG. 4D. During this movement, sliding takes place between the tooth flank surfaces 18 and the bearing surface 16.

The force required to perform the displacement described above depends on several factors, including the force of the spring 8 and the friction between the first tooth flank 18 of the tooth and the corresponding first bearing surface 16 of the notch. On the other hand, the force also depends on the inclination of flank 18 and the corresponding bearing surface 16, because due to this inclination the force in longitudinal direction (substantially horizontal in FIGS. 3, 4A-4D) is broken down into partial forces, one of which is a vertical partial force which compresses spring 8 and releases tooth 10 from its seat in the notch. If the first flank 18 was horizontal in FIG. 4B, there would be no tooth and the force in the direction of arrow 30 would be directly translated into longitudinal displacement. If flank 18 was vertical and came up against an equally vertical bearing surface 16, a transmission of force into a vertical partial force would be prevented and the movement of carriage 3 would be completely blocked. Thus, the geometry of the cooperating shapes of tooth 10 and notch 14 is chosen to determine the thrust force required to effect sliding between surfaces 16, 18 and thus the displacement of the movable part 2 relative to the "fixed" part of clasp 1. Preferably, this force is small enough that a user can easily shorten the clasp 1 as described above. At the same time, this force is high enough to reduce the risk of accidental and unwanted shortening.

In the embodiment shown, the profile of the second flank 19 of tooth 10 does not follow a vertical axis, but the above mentioned angle ß, this angle being preferably more than (greater) 0°, preferably more than 3°, preferably still more than 5° and preferably still more than 7°, e.g. more than 10°, more than 15° or still more than 20°. Since this second flank 19 of tooth 10 is also inclined (as is the case with the first flank 18 and the angle α), the cooperation between this flank 19 and the complementary surface 17 of the notch also does not result in a complete locking in the direction according to arrow 40 (FIG. 5), more precisely in the direction of the extension of the bracelet.

Figure 5:
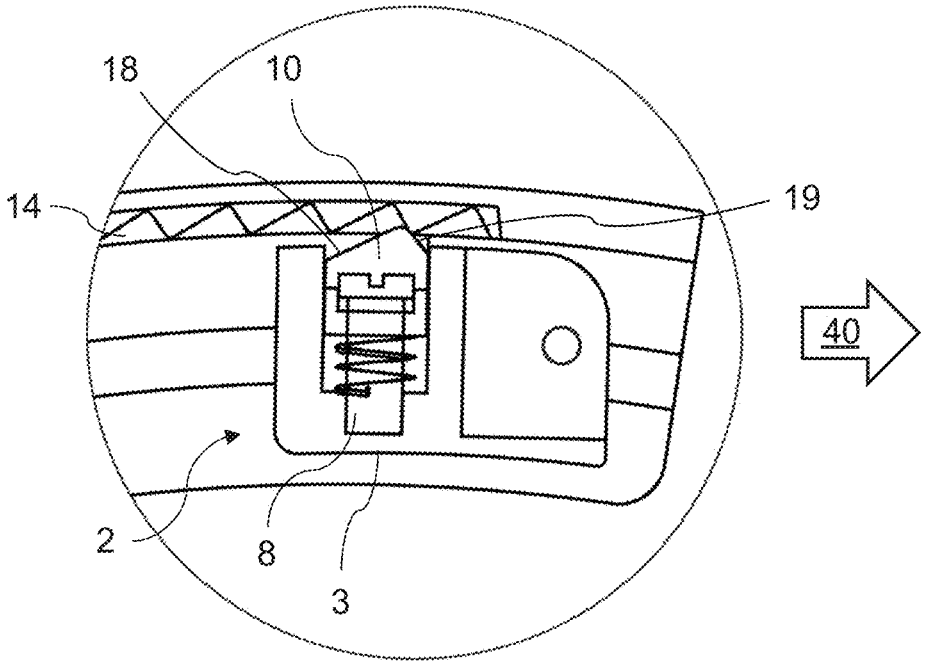
FIG. 5 shows a simplified extract of a longitudinal section of the clasp of FIG. 1 in a particular configuration.

The above information on the configuration of the first flank 16 and the first bearing surface 18 and the shortening also applies to the second flank 19 and the second bearing surface 17 in the context of an increase in the usable length. The operation of the mechanism when extending the fitting length is shown in the sequence of FIGS. 4D, 5 and 4A.

In this case, a user wearing a wristwatch with the clasp grasps the first strand of the bracelet exactly as described above, between the thumb and index fingers. Instead of pushing, the user pulls to extend the working length. In this case, the second flank 19 of tooth 10 is pulled towards the second bearing surface 17, which generates a vertical partial force to push the workpiece 5 further into its seat in slide 3 and thus to release tooth 10 from its seat in notch 14, by sliding between the cooperating surfaces 17, 19, notch 14 and tooth 10 respectively, as shown in FIG. 5.

The shapes or geometrical configurations of the contact surfaces between the second flank 19 and the second complementary and/or co-operating bearing surface 17 are such that the traction force required to effect the movement in the direction of arrow 40 serving to lengthen the bracelet (FIG. 5) is higher than the thrust force required in the opposite direction, according to arrow 30 (FIG. 4B), to shorten the fitting length. The risk of accidental lengthening is then lower than that of accidental shortening.

In the embodiment shown, force adjustment is achieved by the shape and/or profile of the cooperating surfaces 16, 18 and 17, 19, respectively, for shortening and lengthening. Specifically, the force is determined by the choice of angles ß and δ the profile of the second flank 19 and the second bearing surface 17 with respect to the vertical, respectively. As can be seen in FIGS. 49 and 4C, the angles ß and δ are not only greater than 0, but smaller than the angles α, and γ the corresponding opposite faces. In other words, the flank and surface profiles 19, 17 are closer to the vertical, which is why the force required to move in the direction of arrow 40 is higher. In fact, the traction force required to generate the displacement of tooth 10 decreases as the angle of the flanks/bearing surfaces increases and approaches the horizontal (90°). By selecting the profile of the teeth and the corresponding notch, it is possible to adjust the force required to cause the adjustment of the working length. For example, depending on the embodiment, the force required to carry out the extension is greater than that required to carry out the shortening.

Accidental shortening is considered less troublesome, so the risk of accidental lengthening is reduced by the shape and orientation of the contact surfaces between the tooth and the notch. It should be noted that, according to the invention, an accidental change in length is not completely excluded, but the probability of such a change is reduced by the creation of a mechanism requiring a traction force or a thrust force in a desired direction so that an unintentional and accidental change in length becomes unlikely.

The clasp of the present invention allows an adjustment of the useful length of the bracelet by the following preferred features: (1) the absence of a locking mechanism completely blocking the movement of the movable part in at least one direction, preferably in both directions. Therefore, a mechanism intended to be operated by a user to unlock the locking mechanism and thus allow length adjustment is also missing. (2) The fine length adjustment device comprises an indexing member defining discrete length positions. The force required to move the movable part is determined by the shape and orientation of the parts that are intended to slide over each other when adjusting the length. In the embodiment shown in the drawings, the movable part is provided with a tooth and the supporting part has a rack whose notches have a profile substantially complementary to that of the tooth. Of course, the invention is not limited to a particular form of cooperation between the movable part and the supporting part.

For example, the invention can be realised by means of ball ratchets, cooperating with indexing positions having the shape of recesses, for example with a semi-spherical profile. In this case, the force required to perform the movement can be controlled by choosing the profile of the recess.

FIGS. 8 to 10B show a clasp 100 of a second embodiment, in which an indexing member in the form of a rack 106 is arranged on a first or movable part 102, and a stop structure 110 is arranged on a second or supporting part 120.

FIG. 8 shows the entire clasp 100, comprising a first blade 120 with two side rails 121 spaced apart and rigidly connected with a cross strut 124 located at one end of the side rails 21 and/or the first blade 122. The clasp 100 also has a second blade 122 designed to fit into the space between the two side rails 121 of the first blade 120. A first end of the second blade 122 is pivotally mounted to a second end of the first blade 120. As already described above in relation to clasp 1 according to a first embodiment, the second blade 122 comprises two legs 122.1, 122.2, arranged so that they can move closer together when a user activates pushers 128, one of which is arranged on each of the arms 122.1, 122.2, at the second end of the second blade. By bringing the arms together, the clasp can be unlocked and thus opened, as already described.

A second fixing device 112 having the appearance of a pin clasp is arranged at the second end of the second blade 122. A nail (not visible) is arranged on the underside of the cross-plate of the pin clasp 112, enabling a bracelet strand to be fixed by passing this nail through a hole in the strand. It is also possible to provide a pin (not visible) for this purpose.

Figure 9A:
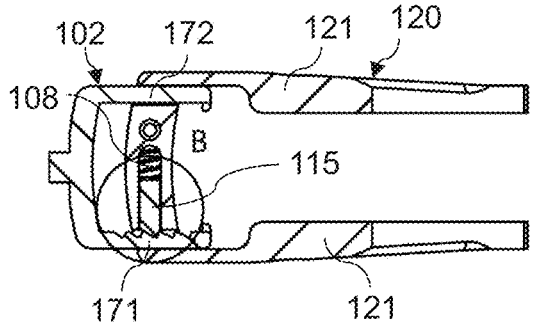
FIGS. 9A and 10A are longitudinal section views along the A-A axis of FIG. 8B, showing the length adjustment mechanism in rest and activated positions, respectively.
Figure 9B:
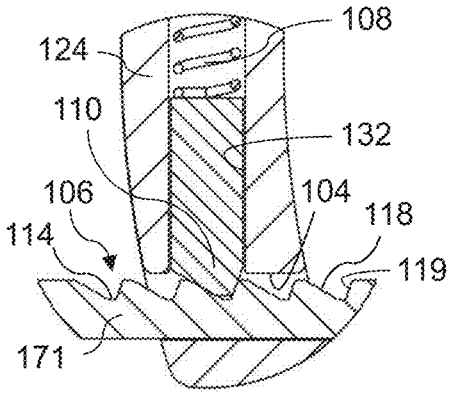
FIGS. 9B and 10B are enlargements of extract B of FIGS. 9A and 10A, respectively.

Unlike clasp 1 of the first embodiment, the movable part 102 of clasp 100 is arranged at the first end of the first blade 121, as shown in FIGS. 9A to 10B. FIGS. 9A and 10A show longitudinal sections through the first blade 120 along the line A-A shown in FIG. 8B.

Figure 10A:
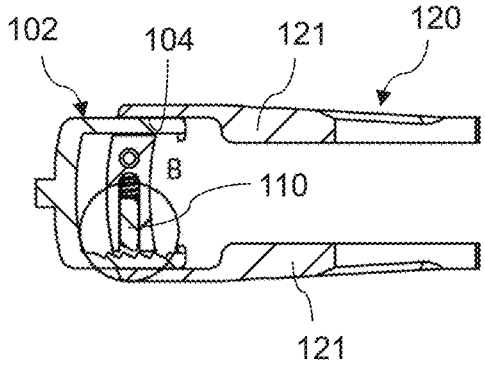

As can be seen in FIGS. 9A and 10A, the movable part 102 is U-shaped, the two free legs or wings 171, 172 being housed in passages and/or channels 104 arranged in the cross strut 124.

An indexing device 106 is arranged on branch 171. In the embodiment shown, this indexing device is a toothed rack 106 arranged on a first branch 171 of the movable part 102. The teeth of rack 106 are oriented in a central orthogonal direction, towards the inside of the clasp.

A stop structure 110 is housed in cross strut 124. The cross strut 124 has an orthogonally elongated cavity or recess 132, which opens towards channel 104. The stop structure 110 is in the form of a bar, one end of which forms a tooth arranged to pass through the opening of the housing 132 and to fit into a notch 114 of the rack 106. A resilient means 108, preferably a spring, is arranged in the blind end of housing 132, in order to bias the stop structure towards the rack to stabilise the cooperation between tooth 110 and a notch 114 of the rack.

The notches 114 of indexing member 106 have shapes and/or profiles that are substantially complementary to that of tooth 110, in order to allow tooth 110 to be received and to determine a position of discrete length, stabilised by the cooperation of complementary shapes, as described above with regards to FIGS. 3, and 4A and 4D.

Figure 10B:
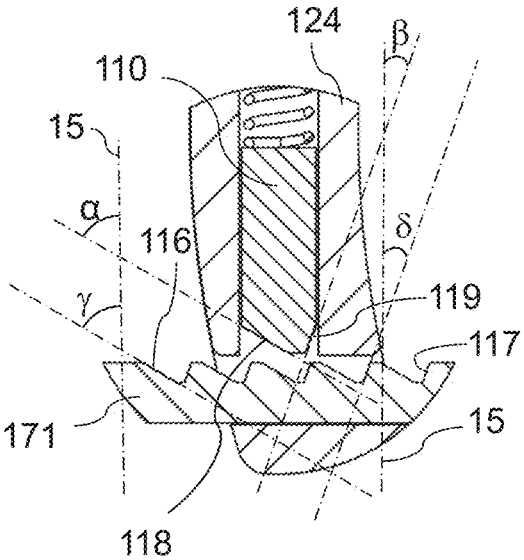
Figure 11:
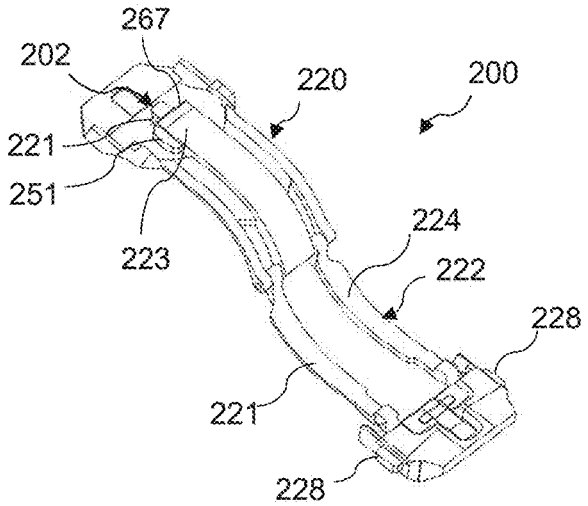
FIG. 11 is a perspective view of a clasp according to a third embodiment of the present invention.

FIGS. 10A and 10B show the stop structure 110 clear of its notch 114, so that the complementary profiles and/or shapes of the cooperation between tooth and notch can be indicated.

As with the first embodiment, tooth 110 and each of the notches 114 have a first profile or flank, 118 and 116 respectively. The first two profiles 118, 116 are intended to be in contact in an indexing position.

Preferably, the first profiles or flanks 118 and 116 are substantially parallel. Therefore, the angles $\alpha$ and $\gamma$ formed between these profiles and the vertical 15 are preferably substantially identical.

Similarly, the second profiles or flanks 119, 117, respectively of tooth and notch 114, intended to be in contact in an indexing position, are preferably substantially parallel. Therefore, the angles ß and $\delta$ formed between these profiles and the vertical 15 are preferably substantially identical.

The indications given above in relation to the geometry and/or the notch and/or tooth profiles of the first method of manufacture apply by analogy to the second embodiment. As in the case of the first embodiment, a user can extend or shorten the useful length of the bracelet by exerting a pull or a push, respectively, on the bracelet strand attached to the first attachment, or directly on this attachment if possible, for example if it can be grasped by the user.

The comparison of the first and second embodiments illustrates, among other things, that the way and/or place where the movable part is arranged on the clasp as a whole can be determined by the person skilled in the art according to embodiment choices or other preferences or constraints and is not a limiting feature of the invention. Likewise, the invention is not limited with respect to the arrangement of the indexing member on the movable part or on the support device.

FIGS. 11 to 14B show a clasp 200 according to a third embodiment, in which the device for adjusting the useful length of the bracelet comprises a locking device with an activating member, arranged in such a way that the length adjusting device can be activated (and thus the useful length adjusted) without or with the activation of said locking device.

The clasp 200 shown in FIGS. 11 to 14B is similar to that shown in document WO2018234474, but adapted to the present invention. The general mechanism of this clasp, in particular the opening mechanism, is not described again below.

The clasp 200 has first and second folding blades 220, 222. The actuating elements 228 for opening the clasp are arranged on the second blade, and the device for adjusting the useful length of the bracelet is arranged on the first blade 220. It should be noted that the second blade 222 has two arms 221 and 224 arranged to be able to move closer in an orthogonal direction when the activating members 228 are depressed, in order to allow the clasp to be unlocked and opened in a similar way to that described above in relation to the first and second embodiments.

The first blade 220 has a support structure or device 223, which is rigidly connected with the first blade and arranged centrally, on the orthogonal direction, on the latter. This support structure can be formed in one piece with the first blade or as a separate piece connected with the first blade, for example.

The support structure 223 has a free end 267, preferably close to a first end of the first blade 220. A movable part 202 is arranged in a longitudinal recess 204 in the support structure 223 so as to emerge from said free end 267.

Figure 12:
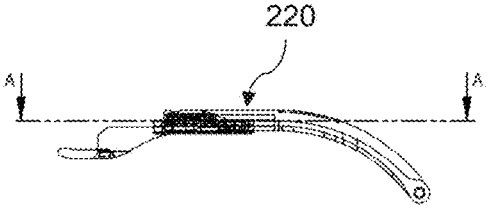
FIG. 12 is an elevation side view of a blade of the clasp shown in FIG. 11.
Figure 13:
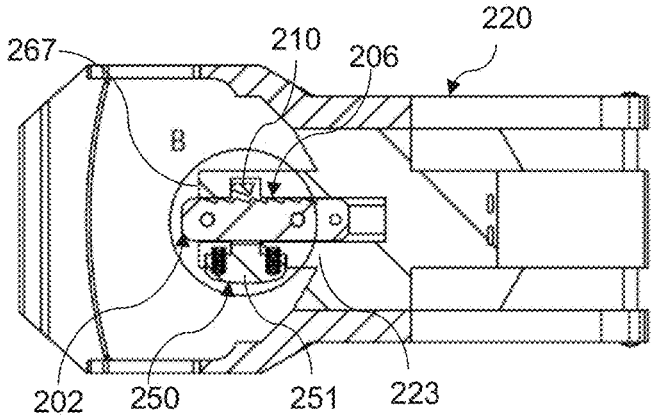
FIG. 13 is a longitudinal view in section according to section A-A in FIG. 12.

On the underside of said movable part 202, a first fastening member 211 is arranged, a second fastening member being arranged on said second blade 222. In FIG. 12, the first fixing device (two nails arranged under the movable part) has been omitted.

Support structure 223 also includes a housing 232 for a stop structure 210 as well as for an activation member 251 connected to said stop structure.

The movable part 202 is housed to be able to slide along a longitudinal direction, and has a rack 206 on one of its sides. The part with the stop structure 210 and the actuator 251 is mounted so that it can move in an orthogonal direction. A rod 252 connects the actuator to the stop structure 210 over the movable part 202, so that the actuator 251 and the stop structure are arranged on both sides of the movable part, connected by the rod.

It should also be mentioned that at least one return means, here two springs 208, are arranged to bias the stop structure in an orthogonal direction towards rack 206, in order to stabilize the cooperation between the stop structure and a notch 214 of the rack.

To activate the fine adjustment device, a user can act on the actuator 251, by pushing on this device, which causes the disengagement of the locking structure 210 from its notch 214 in the rack. The user can then set the useful length of the bracelet as desired, before releasing the actuator 251, generate the cooperation between the locking structure and (another) notch 214 of the rack and thus stabilize a discrete length value.

A special feature of the clasp in FIGS. 11 to 14B is that the actuator 251 of the length adjuster can not only be activated directly, e.g. by pressing it with a finger when the clasp is open, but also indirectly, by activating an actuator 228 of the clasp opening mechanism, as described in more detail in WO2018234474. This is only possible when the clasp 200 is closed. In this configuration, one of the legs 221 of the second blade 222 is aligned with and/or directly next to the actuator 251. Activating push-button 228 connected to branch 221 causes branch 221 to move sideways and this branch to rest on the actuator 251. Thus, the movement of branch 221 of the second blade causes the disengagement of the stop structure 210 of rack 206 by pressing the actuator 251.

Figure 14A:
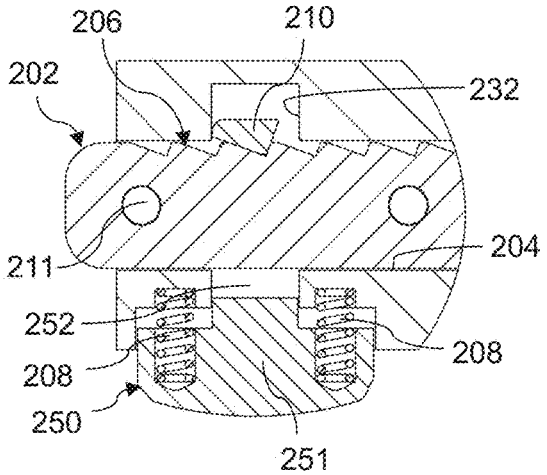
FIGS. 14A and 14B are enlargements of extract B of FIG. 13, in which the length adjustment mechanism is in the rest or activated position, respectively.
Figure 14B:
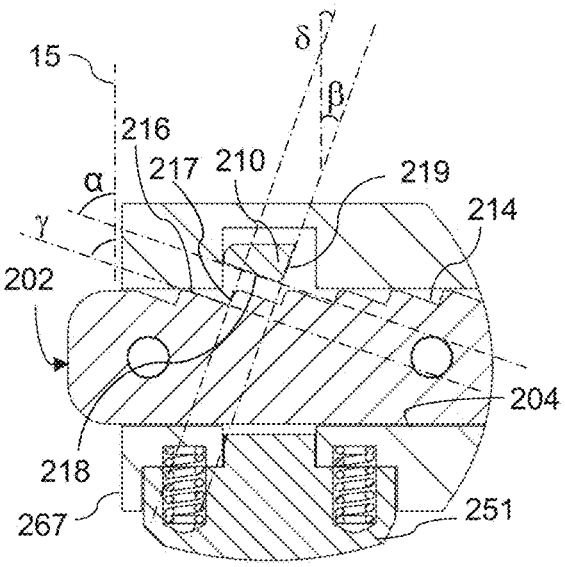

As can be understood from FIGS. 14A and 14B, the stop structure 210 has a tooth whose shape, profile and/or flanks are complementary to the shapes, profiles and/or flanks of notches 214 of rack 206. On the other hand, tooth 210 and each notch 214 has inclined flanks and/or profiles, so as to allow disengagement of tooth 210 from its notch 214 when a force in the longitudinal direction, i.e. a pull or push, is exerted on the movable part 202. Such traction or thrust is typically performed by a user who grasps the bracelet strand connected to the movable part 202 by the fastening device 211 and pulls or pushes the strand to extend or shorten, respectively, the useful length of the bracelet.

Thus, the useful length of the bracelet according to the third embodiment can also be adjusted without activating a locking/unlocking mechanism, in particular without activating a separate actuator, but by pulling and/or pushing directly on the bracelet strand, for example near the end of the strand which is attached to the fastening element.

As indicated above, in one embodiment, the adjusting device is devoid of a locking mechanism to block the length adjustment of the bracelet in at least one direction and/or of an activating member such as a push-piece, a pull-piece and/or a slide. In the case of the clasp shown in FIGS. 11 to 14B, an actuator is present. But preferably, this actuator 251 does not block the movement of the movable part. A locking of the movable part in at least one longitudinal direction is missing, due to the complementary shapes mentioned above.

Figure 8A:
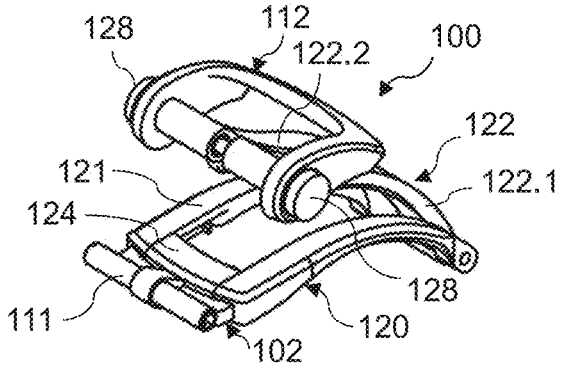
FIG. 8A is a perspective view of a clasp according to a second embodiment of the present invention.
Figure 8B:
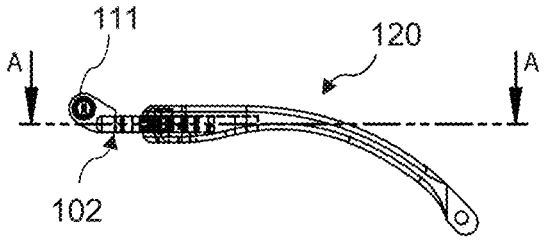
FIG. 8B is an elevation side view of a blade of the clasp shown in FIG. 8A.

In some cases, the fixing device attached to the movable part is protruding and/or accessible to be grasped by a user (e.g. fixing device 111 shown in FIG. 8A). In these cases, the user can logically adjust the length by acting directly on the fixing device instead of pulling/pushing by grasping the bracelet strand. This may be desirable when the bracelet is very flexible and when it is not easy to transmit the force to the movable part by grasping the bracelet strand because of this flexibility.

It is worth mentioning that in several of the embodiments shown, the clasp locking mechanism, i.e. the mechanism designed to prevent accidental opening of the clasp and to allow the clasp to be opened, can be activated independently of the fine adjustment mechanism. The fine adjustment mechanism can be activated separately and independently of the clasp locking device. On the other hand, the useful length of the bracelet can be adjusted when the clasp is open, but also when it is closed, even when the wristwatch is in service mode, on a user's wrist.

The person skilled in the art will encounter no particular difficulty in adapting the contents of the present disclosure to his or her own needs, and in implementing a clasp, in particular for a time piece, without going beyond the ambit of the present invention. For example, the person skilled in the art can adapt the teaching to a pin clasp or a combined clasp (pin clasp/folding blades). In combined clasps, the clasp has folding blades, and at least one fixing device is in the form of a pin clasp. More generally, the length adjusting device according to the invention can be adapted to other types of clasps, in particular for wristwatches. On the other hand, the person skilled in the art will understand that the positioning of the stop structure (e.g. the tooth) and the indexing member (e.g. the rack) on the movable part and the support part, respectively, is the result of an embodiment choice. The invention covers the possibility of positioning the indexing member on the movable part and the stop structure on the support part of the length adjusting device.

The invention claimed is:

1. A clasp for bracelets comprising a device for adjusting the useful length of the bracelet, said device for adjusting the useful length comprising a movable part and a support device, the movable part being arranged to be able to do a displacement with respect to said support device during a length adjustment, one chosen from said movable part and said support device comprising a stop structure and the other comprising an indexing member, said stop structure being intended to be positioned in a notch of the indexing member, in order to determine a discrete and stable value of the length of the bracelet, wherein said movable part, said stop structure and said notch are arranged such that when a determined force is exerted by a user, said force acting in a longitudinal direction on said movable part or on a bracelet strand connected to said movable part, said force is transmitted to said stop structure so as to disengage said stop structure from said notch and to cause a displacement of the movable part in the longitudinal direction resulting in an extension of said useful length of the bracelet, wherein the clasp is arranged to allow length adjustment when the clasp is in the open position as well as when the clasp is in the closed position, wherein said indexing member and said stop structure of the movable part are arranged such that the force in longitudinal direction required to carry out a movement of the movable part used to shorten the length of the bracelet is smaller than the force required to carry out a movement of the movable part used to lengthen the bracelet, and wherein said stop structure comprises a tooth, wherein said tooth and/or said notch comprises first and second bearing surfaces which are plane and inclined with respect to the direction of movement of the movable part, the profile and/or inclination of the bearing surfaces determining at least partially said forces required to carry out said movements of the movable part.

2. The clasp according to claim 1, wherein said movable part is arranged with respect to the indexing member in such a way that the movement of the movable part during the application of a thrust exerted by a user acting directly on said movable part or on a bracelet strand connected to said movable part causes the useful length of the bracelet to be shortened.

3. The clasp according to claim 1, wherein the thrust and/or traction force required to allow the movement of the movable part are further determined at least in part by the profiles and/or shapes of the notches for receiving said stop structure in order to determine said discrete and stable length value.

4. The clasp according to claim 1, wherein said indexing member comprises a plurality of notches, said notches comprising at least one contact structure and said stop structure comprising said bearing surfaces arranged to be in contact with said contact structure and to slide on said contact structure during the movement of the movable part causing the extension and/or shortening of the useful length of the bracelet.

5. The clasp according to claim 1, wherein each of said first and second bearing surfaces, when viewed in profile, follows a straight line, each of the straight lines forming an angle ($\alpha$, ß) with respect to a radial axis, each of the angles ($\alpha$, ß) being non-zero.

6. The clasp according to claim 1, wherein said movable part comprises a carriage and said stop structure is arranged relative to the carriage so as to be movable in a direction including a radial component, the radial component of the movement allowing said stop structure to slide over a support structure of a notch and to disengage from said notch in which said structure is positioned.

7. The clasp according to claim 1, wherein said force in longitudinal direction required to carry out the movement of the movable part used to shorten the length of the bracelet is a push and the force required to carry out the movement of the movable part used to lengthen the bracelet is a pull.

8. The clasp according to claim 1, wherein said adjusting device is devoid of a locking mechanism for blocking the length adjustment in at least one direction of the bracelet length and/or of an activating member such as a push-piece, a pull-piece and/or a slider, said activating member being intended to unblock a locking mechanism in order to allow the length adjustment in at least one direction of the bracelet length.

9. The clasp according to claim 1, wherein said length adjustment is a discontinuous fine length adjustment in discrete length values.

10. A clasp for bracelets having a length adjusting device, wherein said adjusting device is devoid of a locking mechanism for blocking a length adjustment in at least one direction of the bracelet length and/or of an activating member such as a push-piece, a pull-piece and/or a slide, said activating member being intended to unblock a locking mechanism in order to allow the length adjustment in at least one direction of the bracelet length, wherein said length adjustment is a discontinuous fine length adjustment comprising discrete length values, wherein said length adjusting device comprises a support device and a movable part, said support device comprising a cover and said movable part being movable with respect to said cover, said movable part comprising a carriage, a stop structure provided in said carriage and resilient means, said resilient means being provided in said carriage to bias said stop structure in a radially upwards direction towards said cover so as to stabilize said stop structure with respect to said support device, thereby providing said length adjustment at one of said discrete length value.

11. The clasp according to claim 10, wherein said length adjusting device further comprises an indexing member, wherein said a stop structure is intended to be positioned in a notch of said indexing member in order to determine a discrete length value, wherein said movable part, said stop structure and said notch are arranged so that, when a determined force is exerted in a longitudinal direction on said movable part or on a bracelet strand connected to said movable part, said force being capable of being exerted by a user, said force acts on said stop structure so as to disengage said stop structure from said notch and to generate a displacement of the movable part in the longitudinal direction resulting in the lengthening or shortening of said useful length of the bracelet.

12. The clasp according to claim 11, wherein said indexing member and said stop structure of the movable part are arranged such that the force required to carry out the movement of the movable part used to shorten the length of the bracelet is smaller than the force required to carry out the movement of the movable part used to lengthen the bracelet.

13. The clasp according to claim 10, which it is arranged to allow length adjustment when the clasp is in the open position as well as when the clasp is in the closed position.

14. The clasp according to claim 10, wherein said length adjustment is a discontinuous fine length adjustment in discrete length values.

15. The clasp according to claim 10, wherein said indexing member, said movable part and said stop structure are arranged such that the force in longitudinal direction required to carry out a movement of the movable part used to shorten the length of the bracelet is smaller than the force required to carry out a movement of the movable part to lengthen the bracelet.

* * * * *